United States Patent [19]

Messuri

[11] 4,003,180

[45] Jan. 18, 1977

[54] EDGE MOLDING

[76] Inventor: Peter C. Messuri, 7824 Biltmore Blvd., Miramar, Fla. 33023

[22] Filed: Apr. 8, 1976

[21] Appl. No.: 674,835

[52] U.S. Cl. ..... 52/716; 4/172.21; 24/73 FT; 248/345.1; 52/169.7; 52/179; 52/624

[51] Int. Cl.[2] ..... E04F 19/02

[58] Field of Search ..... 52/716–718, 52/179, 211, 288, 241, 290, 312, 459, 506, 601, 512, 623, 624, 169; 24/73 FT; 248/345.1; 49/460–462; 4/172, 172.21

[56] References Cited

UNITED STATES PATENTS

| | | | |
|---|---|---|---|
| 2,030,730 | 2/1936 | Wilson | 52/624 |
| 2,835,937 | 5/1958 | Hobbs | 52/623 X |
| 3,391,509 | 7/1968 | Fruman | 52/211 |
| 3,523,710 | 8/1970 | Barecki et al. | 248/345.1 |
| 3,568,386 | 3/1971 | Gossen | 52/288 |

FOREIGN PATENTS OR APPLICATIONS

| | | | |
|---|---|---|---|
| 1,397,939 | 3/1965 | France | 52/717 |
| 45,779 | 9/1935 | France | 52/717 |
| 149,860 | 12/1931 | Switzerland | 52/716 |

*Primary Examiner*—J. Karl Bell

[57] ABSTRACT

This invention relates to edge molding coupled by a fastener to the edge section of a surface. The edge molding includes an elongated strip of relatively flexible material having a generally W-shaped cross-section defined by a first shielding flap, a central stem section and a second shielding flap. The edge section of the surface is coupled between the first shielding flap and the central stem section, and attached to the central stem section by the fastener communicating therethrough. The first shielding flap and the second shielding flap are of sufficient cross-sectional length to overlap and cover the ends of the fastener.

11 Claims, 3 Drawing Figures

EDGE MOLDING

BACKGROUND OF THE INVENTION

1. Field of the Invention

This invention relates to molding of the type used to protect edge sections of elongated surfaces.

2. Description of the Prior Art

The static structures art is replete with examples of special purpose edge molding. Vojta in U.S. Pat. No. 2,662,620 discloses a trim molding reinforcement for luggage seams. A central section of this special purpose edge molding is sandwiched between and forms an integral part of the coupling between the two edges of two separate surfaces. Schemmel in U.S. Pat. No. 2,047,747 discloses a trimming strip or molding particularly adapted to be applied to automobile seats for covering and trimming the juncture of the two surface portions of the seat, such as the front and back sections thereof. Fall in U.S. Pat. No. 2,288,563 discloses edge molding for a table top surface or the like. Feldman in U.S. Pat. No. 2,636,189 discloses an edge molding for being used as a teething rail on an upper horizontal bar or edge portion of a child's crib or playpen. Victor in U.S. Pat. No. 1,694,522 discloses edge molding for use in flush-mounted doors. Bourne et al in U.S. Pat. No. 2,833,033 disclose edge molding for use in prefabricated structural panels. Fox in U.S. Pat. No. 3,347,006 discloses an edge molding or coping of the type used to provide protection for the circumferential edge surfaces of swimming pools. Other trim molding designs are disclosed by Wall in U.S. Pat. No. 3,562,822; Engelhart in U.S. Pat. No. 3,835,481; Viessmann in U.S. Pat. No. 3,641,595; Shields in U.S. Pat. No. 3,351,958; Kessler in U.S. Pat. No. 3,590,400; West in U.S. Pat. No. 3,557,391; and Mason in U.S. Pat. No. 2,830,003.

SUMMARY OF THE INVENTION

The present invention relates to edge or trim molding for being coupled by a fastener to an edge section of a surface. The edge molding includes an elongated strip of relatively flexible material, with the strip being generally T-shaped in cross-section, with a stem section thereof coupled to the surface by a fastener communicating therethrough. A bridge section of the molding includes a distended first end sufficiently displaced from the stem section to overlap the edge section of the surface. A first flanged section is integrally formed at the distended first end of the bridge section, with the first flange section extending in the same direction as the stem section and having a cross-sectional length sufficient to overlap a first end of the fastener adjacent thereto. A distended second end of the bridge section includes a second flange integrally formed therewith for extending in the same direction as the stem section. The second flange has a sufficient cross-sectional length to communicate with and to overlap the second end of the fastener adjacent thereto, whereby the edge section of the surface and the fastener are completely enclosed by the trim molding.

In contrast with the prior art, the present invention relates to elongated pliable molding which is specifically designed to shield edge surfaces of articles used in swimming pools. For example, molded acrylic stairs of the type inserted at a corner or end sections of a swimming pool often include sharp edge sections which are capable of cutting through or abrading the skin surface of a person grasping the edge of the material. In this respect, the molding serves to protect the occupants of the pool from cuts and other similar hazards inherent with the type of materials used in producing the drop-in steps.

Also, many newer swimming pool designs incorporate continuous vinyl or plastic liners which are placed within an excavated hole for the purpose of defining a water impenetrable boundary. Since only a thin layer of the plastic or vinyl substance is utilized throughout the pool, some form of abrasion protection must be provided with other structures, such as preformed steps, are inserted into the pool. This extra protection is especially required when these structures derive some support from the bottom and vertical wall portions of the pool. In particular, when acrylic steps are inserted into the pool, some type of soft vinyl molding must be included about the periphery of the structure to provide a cushioned, anti-abrasion coupling between the edge surface of the structure and the vinyl pool liner.

Since the trim coping must remain attached to the molded steps while being submerged in a chlorinated water solution, it has heretofore been impractical to utilize an adhesive-type bond between the molded steps and the trim coping. Instead, the prior art has utilized shaft-type fasteners constructed of noncorrosive materials. The shaft type fasteners communicate through and couple the molded section of the stairs with the central section of the molding. However, if the heads of the shaft-type fasteners are left exposed, they may induce skin abrasions or other superficial injuries to persons using the stairs, or they may, over a period of time, wear through or puncture the vinyl swimming pool lining. Such a breach of the vinyl swimming pool lining, especially at the bottom of the pool, can cause substantial expense and trouble for the pool owner.

THE DRAWINGS

Other objects, features and advantages of the present invention will be apparent from a study of the written description and the drawings in which.

DETAILED DESCRIPTION OF THE PREFERRED EMBODIMENT

Figure 1:
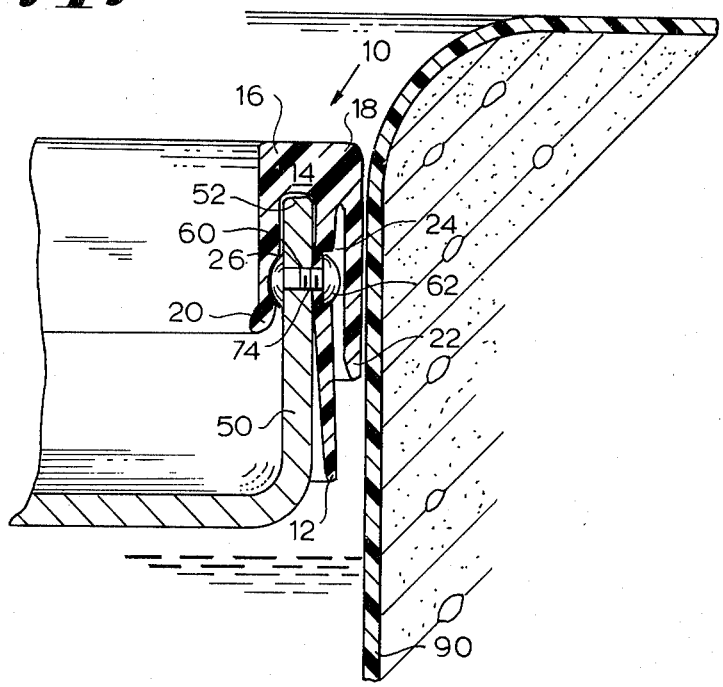
FIG. 1 is a cross-sectioned view of the trim molding as installed on a structure inserted within a swimming pool employing a flexible vinyl liner.
Figure 2:
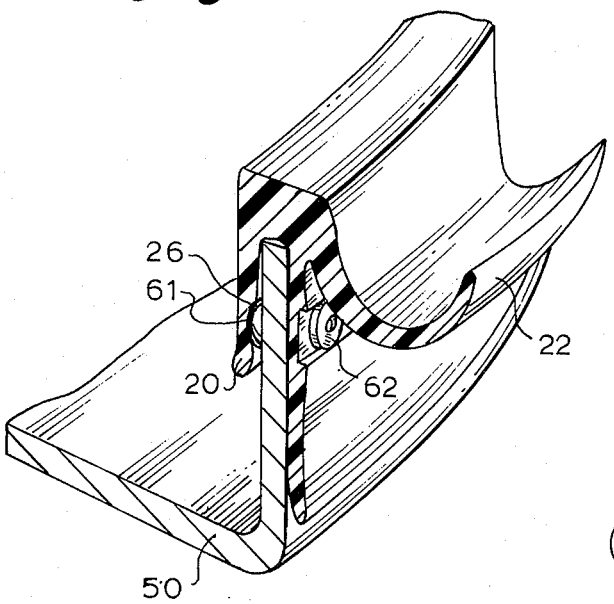
FIG. 2 is a perspective cross-sectional view of the vinyl trim applied to the edge surface of a structure.
Figure 3:
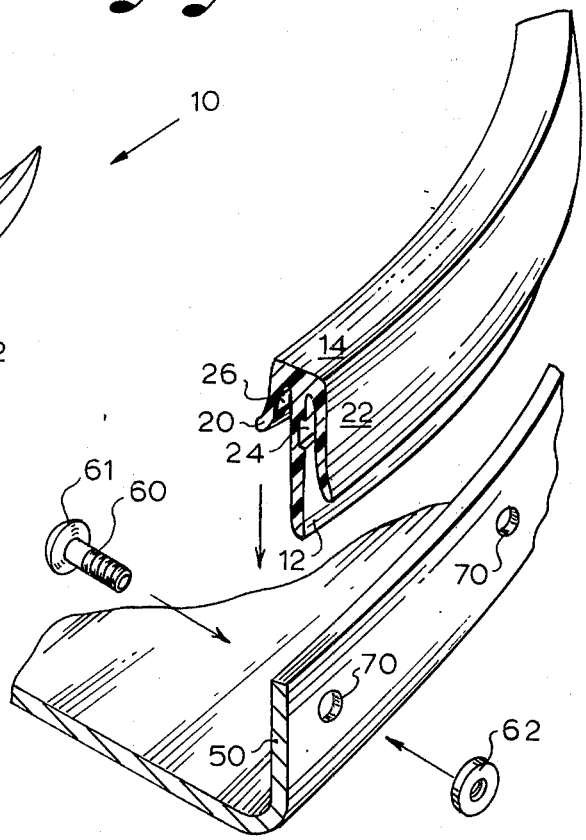
FIG. 3 is a perspective exploded view showing the coupling of the trim molding with the edge surface of the structure.

A first preferred embodiment of the trim molding or edge coping is shown generally as 10 in FIGS. 1, 2 and 3. The trim molding 10 is composed of an elongated strip of relatively flexible material having generally a T-shaped cross-section. A stem section 12 of the trim molding 10 is coupled to a planar surface 50 by a shaft-type fastener 60 communicating therethrough. A flat surface of the stem section 12 is in close coplanar communication with the surface 50, with an edge section 52 of the planar surface 50 being in close communication with a bridge section 14 of the molding 10. The bridge section 14 includes a distended first end 16 which is displaced from the stem section 12 by a distance sufficient to overlap the edge section 52 of the surface 50. A first flange 20, or first shielding flap, is integrally formed at the distended first end 16 of the bridge 14 and extends in the same direction as the stem section 12. The effective cross-sectional length of the first flange 20 is sufficient to overlap a first head 61 at one end of a shaft-type fastener 60. A second end section 18 of the bridge section 14 includes a second flange 22, or second shielding flap, integrally formed therewith for extending in the same direction as the stem section 12. The second flange 22 is of sufficient cross-sectional length to communicate with and overlap a second end or second head section 62 of the shaft-type fastener 60.

An elongated first channel 24 is recessed along the elongated length of the stem section 12 on the side not in communication with the surface 50. The first channel 24 is of sufficient width and depth for receiving therein the second head section 62 of the shaft-type fastener 60. While the first channel 24 has been designated as being recessed within the stem section 12, it will be obvious to one skilled in the art that an annular or disc-shaped recess may be substituted therefor without departing from the scope or spirit of the present invention. However, if the present trim molding is to be manufactured by extrusion techniques, it is desirable to employ the elongated channel 24 rather than a series of singular recessed areas. The use of an elongated channel would allow fasteners to be spaced at random along the length of the channel as required by the specific application. Furthermore, while a shaft-type fastener 60 has been specified, other fasteners of similar functional performance are envisioned to be within the scope of this invention. Fasteners of this type include rivets, screws and nuts, bent shaft fasteners, and any other device which includes end sections which must be protected from inadvertent snagging or abrasion.

An elongated head channel 26 is recessed along the elongated length of the first flange 20. The elongated head channel 26 is located in an inside surface of the first flange 20 adjacent to the planar surface 50. The width and depth of the elongated head channel 26 are sufficient to receive therein the first head section 61 of the shaft-type fastener 60.

The trim molding 10 may be installed using several different techniques. A first technique involves boring a hole or an aperture, shown as 70 in FIG. 3, through the planar surface 50 at a location calculated to allow the edge section 52 thereof to seat adjacent to the bridge section 14 of the trim molding 10. A coaxial aligning hole 74 is then drilled through the stem section 12 and into the first channel 24. The trim molding 10 may then be placed upon the planar surface 50 to allow the shaft-type fastener 60 to be then secured through the hole 70 in the planar surface 50 and the hole 74 in the stem section 12. The shaft-type fastener 60 is then secured by attaching a nut or another end section 62 thereto. The first flange 20 and the second flange 22 may then be folded down over the distended end or head sections 61 and 62 of the shaft-type fastener 60.

A second installation technique requires the trim molding 10 to be coupled to the planar surface 50 such that the edge section 52 thereof is in close communication with the bridge section 14. A hole is then drilled continuously through the second flange 22, through the stem section 12 and through the planar surface 50. The shaft-type fastener is then inserted through the hole 70 of the planar surface 50 and through the hole 74 within the first channel 24 in the stem section 12. The second head section or nut 62 may then be attached to the fastener 60. If the second end of the shaft-type fastener 60 does not protrude through the second head section 62, then the second head section 62 will communicate with the second flange 22 and shield the shaft-type fastener 60 from communicating with a vinyl or plastic liner 90 forming the water-confining surface of the swimming pool.

The trim molding 10 may be manufactured from any relatively flexible material that can withstand an extended period of exposure to adverse environmental elements, such as ultraviolet light from the sun and submersion in chlorinated water. While an extruded vinyl substance has been chosen for use in the first preferred embodiment of the present invention, other similar substances can be substituted therefor without departing from the scope or spirit of the invention.

It should be understood at this point that the present invention should not be limited in its application to the construction details and the illustrated parts of the accompanying drawings, since this invention may be constructed or practiced in a variety of different embodiments. Also, it must be understood that the terminology and descriptions employed herein are used solely for the purpose of illustrating the general operation of the preferred embodiment, and therefore should not be construed as limitations on the operability of the invention.

I claim:

1. Trim molding for being coupled by a fastener over the edge section of a surface, said trim molding comprising: an elongated strip of relatively flexible material, said strip being generally T-shaped in cross-section, with a stem section thereof coupled to said surface by said fastener communicating therethrough, and wherein a bridge section of said strip includes a distended first end displaced from said stem section sufficient to overlap said edge section of said surface, with said bridge section having a first flange integrally formed at said first end thereof, said first flange extending in the same direction as said stem section and of a cross-sectional length sufficient to overlap a first end of said fastener adjacent thereto, and wherein a distended second end of said bridge section includes having a second flange integrally formed therewith for extending in the same direction as said stem section, with said second flange having a sufficient cross-sectional length to communicate with and overlap a second end of said fastener adjacent thereto, whereby said edge section of said surface and said end sections of said fastener are completely enclosed by said trim molding.

2. The trim molding as described in claim 1 further including an elongated first channel recessed along the elongated length of said stem section adjacent said second flange, said elongated first channel being of sufficient dimensions for receiving therein said second end of said fastener.

3. The trim molding as described in claim 2 wherein said second flange is of sufficient cross-sectional length to overlap said elongated first channel.

4. The trim molding as described in claim 2 further comprising an elongated head channel recessed along the elongated length of said first flange, said elongated head channel being located in an inward facing portion of said first flange adjacent to said surface and said fastener, with said elongated head channel of sufficient dimensions for receiving therein said first end of said fastener.

5. The trim molding as described in claim 4 further comprising bores communicating through said stem section of said elongated strip within said elongated first channel for receiving therethrough said fasteners.

6. Edge molding for being coupled by a shaft-type fastener to the edge section of a surface, said edge molding comprising: an elongated strip of relatively flexible material, said strip being generally W-shaped in cross-section and defined by a first shielding flap, a central stem section and a second shielding flap, with said edge section of said surface coupled between said first shielding flap and said central stem section and being fastened to said central stem section by said shaft-type fastener communicating therethrough, with said first shielding flap and said second shielding flap being of sufficient cross-sectional length to overlap and cover ends of said shaft-type fastener.

7. The edge molding as described in claim 6 wherein said central stem section includes therein first recessed means for receiving therein an end section of said shaft-type fastener.

8. The edge molding as described in claim 7 wherein an inward facing surface of said first shielding flap includes therein head recessed means for communicating with another end section of said shaft-type fastener.

9. The edge molding as described in claim 8 wherein said first recessed means and said head recessed means each comprise elongated channels recessed within said edge molding.

10. The edge molding as described in claim 8 wherein said second shielding flap communicates coplanarly with said stem section, and wherein said first shielding flap communicates coplanarly with said surface.

11. The edge coping as described in claim 10 wherein said edge coping is an extruded vinyl material.

* * * * *